United States Patent [19]

Schirk et al.

[11] Patent Number: 4,498,752

[45] Date of Patent: Feb. 12, 1985

[54] ARRANGEMENT FOR SPACING AND CONVEYING OVERLAPPING PHOTOSENSITIVE ARTICLES

[75] Inventors: Günter Schirk; Horst Köninger, both of Munich, Fed. Rep. of Germany

[73] Assignee: Agfa-Gevaert Aktiengesellschaft, Leverkusen, Fed. Rep. of Germany

[21] Appl. No.: 481,047

[22] Filed: Mar. 31, 1983

[30] Foreign Application Priority Data

Apr. 3, 1982 [DE] Fed. Rep. of Germany ..... 3212478

[51] Int. Cl.[3] ..... G03D 9/00

[52] U.S. Cl. ..... 354/301; 354/320; 354/339

[58] Field of Search ..... 354/301, 302, 303, 305, 354/319, 338, 339, 320

[56] References Cited

U.S. PATENT DOCUMENTS

| | | | |
|---|---|---|---|
| 2,786,401 | 3/1957 | Briggs et al. | 354/301 |
| 3,136,238 | 6/1964 | Corona | 354/302 |
| 4,334,757 | 6/1982 | Byers | 354/301 |

FOREIGN PATENT DOCUMENTS

| | | | |
|---|---|---|---|
| 2043693 | 3/1972 | Fed. Rep. of Germany | 354/302 |

OTHER PUBLICATIONS

German Gebrauchsmuster 7036989, Jan. 14, 1971.

*Primary Examiner*—A. A. Mathews

*Attorney, Agent, or Firm*—Peter K. Kontler

[57] ABSTRACT

An arrangement for conveying superimposed photographic sheets into a processing bath includes a pair of cooperating rollers each of which has a central section of reduced diameter. A guide sheet having the shape of an isosceles triangle is arranged downstream of the rollers. The apex of the guide sheet confronts the rollers while the base is remote from and extends parallel to the rollers. A wedge-shaped ledge spans the guide sheet adjacent to the base on either side of the guide sheet. The ledges function to space the superimposed photographic sheets being conveyed. A tongue which initially separates the photographic sheets projects upstream from the apex of the guide sheet and extends between the central sections of the rollers. A part-spherical protuberance is formed on either side of the junction between the tongue and the guide sheet. The protuberances displace the photographic sheets so that the leading edges of the latter do not catch at the corners between the tongue and the guide sheet.

28 Claims, 3 Drawing Figures

ARRANGEMENT FOR SPACING AND CONVEYING OVERLAPPING PHOTOSENSITIVE ARTICLES

BACKGROUND OF THE INVENTION

The invention relates generally to an arrangement for conveying overlapping photosensitive articles.

More particularly, the invention relates to an arrangement for conveying a pair of overlapping photosensitive sheets into a bath of a diffusion developing apparatus while maintaining the sheets at a distance from one another.

A known arrangement for conveying a pair of overlapping photosensitive sheets while maintaining a distance between the same includes a pair of conveying rollers. Each of the rollers has a central portion of reduced diameter. A guide element is provided to separate the sheets and includes a plate which resembles an isosceles triangle. The guide plate is located downstream of the rollers and is arranged in such a manner that the apex confronts the rollers while the base is remote from and extends parallel to the rollers. A tongue projects upstream from the apex and passes between the central portions of the rollers, that is, the portions of the rollers having reduced diameters. On both sides, the guide plate is formed with a ledge which extends along the base of the guide plate. The ledges serve to space the photosensitive sheets from one another.

A conveying arrangement of the type described above is known from the German Offenlegungsschrift No. 20 43 693 as well as the German Gebrauchsmuster No. 70 36 989. In these known arrangements, the tongue is of one piece with the triangular guide plate.

The known conveying arrangements have a disadvantage which stems from the relatively high flexibility of modern photosensitive materials. This disadvantage resides in that the leading edges of the photosensitive sheets abut against the front edges of the triangular guide plate in the transition region between the tongue and the guide plate so that further advancement of the sheets is prevented. The sheets thus become damaged and cannot be subjected to further processing. When processing sheets of different width, it is also found that the lateral edges of wide sheets in particular are readily creased by the conveying rollers.

OBJECTS AND SUMMARY OF THE INVENTION

It is an object of the invention to provide a conveying arrangement for overlapping photosensitive articles which reduces the chances of unintentional blockage of the articles.

Another object of the invention is to provide a conveying arrangement for overlappping photosensitive articles which reduces the chances of damage to the articles.

An additional object of the invention is to provide a conveying arrangement for overlapping photosensitive articles which reduces the chances of damage to the lateral edges of wide articles.

The preceding objects, as well as others which will become apparent as the description proceeds, are achieved by the invention.

One aspect of the invention resides in an arrangement for conveying overlapping photosensitive articles. The arrangement comprises the following:

A. Conveying means for conveying a pair of overlapping photosensitive articles in a predetermined direction. The conveying means may, for example, include a pair of cooperating rollers. Each such roller preferably has a central section which is flanked by a pair of lateral sections having larger diameters than the respective central section.

B. Guide means arranged to guide the articles for movement on opposite sides of a predetermined plane. The guide means includes a first portion or sheet which is located in the predetermined plane and has an upstream end provided with a corner. The guide means further includes a second portion or tongue which extends upstream from the upstream end of the sheet. The sheet and the tongue define a junction region having opposite faces which flank the predetermined plane. At least one of these faces, and preferably each of these faces, is provided with a protuberance to thereby bias the respective article away from the predetermined plane.

According to one embodiment of the invention, the guide sheet resembles an isosceles triangle. The guide sheet is arranged in such a manner that the apex constitutes the upstream end thereof while the base constitutes the downstream end thereof. The tongue projects upstream from the apex and passes between the central sections of the rollers which are bounded by sections of larger diameter. A ledge extends along the base of the guide sheet on either side of the latter. The ledges serve to maintain a spacing between the overlapping photosensitive articles.

When a photosensitive article such as a flexible photographic sheet passes by a protuberance, a wave or ridge is formed in the photographic sheet thereby stiffening the same. This enables the photographic sheet to be lifted over the critical radii at the junction between the tongue and the guide sheet. It is true that the stabilizing effect achieved at the center of the photographic sheet decreases towards the lateral edges of the same. Nevertheless, the delta configuration of the guide sheet enables the sheet to be lifted so far above the respective ledge that the lateral edges of even large photographic sheets can be readily separated from one another.

According to another embodiment of the invention, each of the rollers has a pair of end sections which flank the central and lateral sections of the respective roller and have a smaller diameter than the lateral sections. This reduces the chances that the edges of the photographic sheet, which are not stiffened to the same degree as the center, will be creased.

The arrangement in accordance with the invention is well-suited for conveying a pair of photographic sheets into or through a bath of a diffusion developing apparatus while maintaining the photographic sheets at a distance from one another.

The novel features which are considered as characteristic of the invention are set forth in particular in the appended claims. The improved conveying arrangement itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figures 1, 2, 3:
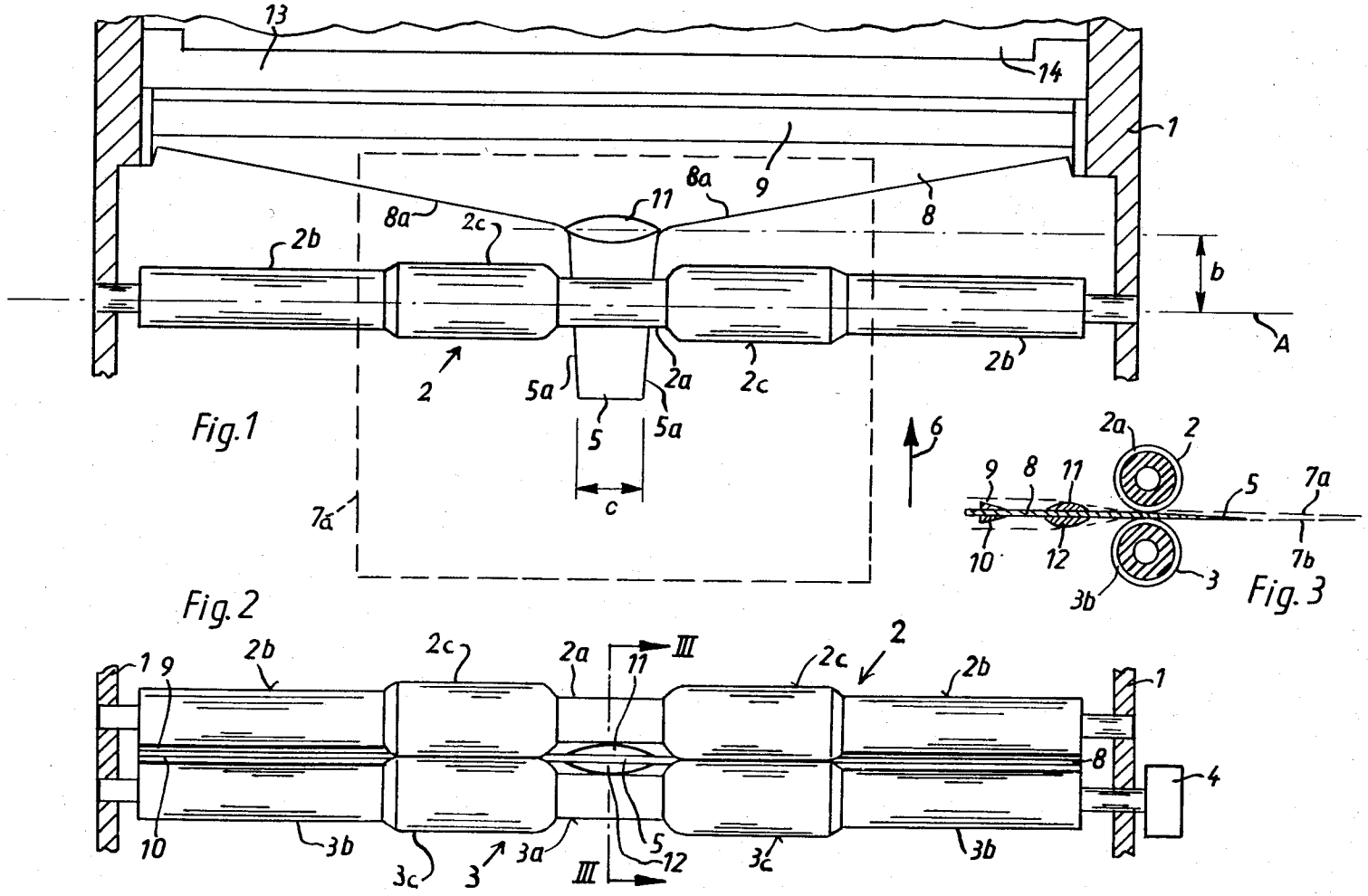
FIG. 1 is a schematic plan view of a conveying arrangement according to the invention.
FIG. 2 is a front view of the arrangement of FIG. 1.
FIG. 3 is a cross-sectional view in the direction of the arrows III—III of FIG. 2.

In FIGS. 1 and 2, the reference numeral 1 identifies the wall of a diffusion developing apparatus. The developing apparatus accommodates a processing bath 14, e.g. a developing bath, and overlapping photographic sheets 7*a* and 7*b* (see also FIG. 3) are transported into the bath 14 in the direction indicated by the arrow 6. Deflectors 13 are mounted on the wall 1 upstream of the bath 14.

A conveying arrangement for transporting the photographic sheets 7*a*, 7*b* into the bath 14 is located upstream of the deflectors 13. The conveying arrangement includes a pair of cooperating conveying rollers 2 and 3 which are rotatably mounted on the wall 1. The lower roller 3 is connected with a drive 4 arranged outside the wall 1 of the developing apparatus.

The roller 2 has a central section 2*a* which is flanked by a pair of lateral sections 2*c*. The diameters of the lateral sections 2*c* exceed the diameter of the central section 2*a*. The roller 2 further has a pair of end sections 2*b* which flank the lateral sections 2*c* and the central section 2*a* and have a smaller diameter than the lateral sections 2*c*. Each of the end sections 2*b* has a length which is of the order of $\frac{1}{4}$ to $\frac{1}{3}$ of the overall length of the roller 2.

The roller 3 similarly has a central section 3*a* which is flanked by a pair of lateral sections 3*c*. The diameters of the lateral sections 3*c* exceed the diameter of the central section 3*a*. The roller 3 further has a pair of end sections 3*b* which flank the lateral sections 3*c* and the central section 3*a* and have smaller diameters than the lateral sections 3*c*. The length of each end section 3*b* is of the order of $\frac{1}{4}$ to $\frac{1}{3}$ of the overall length of the roller 3.

The conveying arrangement further includes a guide member which causes the photograhic sheets 7*a*, 7*b* to be transported into the bath 14 separately, that is, which causes the photographic sheets 7*a*, 7*b* to be maintained at a distance from one another as the photographic sheets 7*a*, 7*b* are transported into the bath 14. The guide member comprises a guide sheet or guide plate 8 which is located downstream of the rollers 2, 3 and resembles an isosceles triangle. The guide sheet 8 is located in a horizontal plane which passes through the nip defined by the rollers 2, 3. The apex of the guide sheet 8 confronts the rollers 2, 3 while the base of the guide sheet 8 is remote from the rollers 2, 3. The base of the guide sheet 8 is parallel to the rollers 2, 3 and normal to the direction of transport 6 of the photographic sheets 7*a*, 7*b*. The width of the guide sheet 8, that is, the length of the base of the guide sheet 8, is approximately equal to the length of the rollers 2, 3. The guide sheet 8 is mounted on the wall 1 of the developing apparatus.

A ledge 9 is formed on the upper surface and adjacent to the base of the guide sheet 8. The ledge 9 is parallel to the base of the guide sheet 8 and extends across the entire width of the latter. A second ledge 10 is formed on the lower surface and adjacent to the base of the guide sheet 8. The ledge 10 is also parallel to the base of the guide sheet 8 and again extends across the entire width of the guide sheet 8. The ledges 9 and 10, which are wedge-shaped and serve to space the photographic sheets 7*a*, 7*b* from one another about the plane of the guide sheet 8, are superimposed with each other.

The guide member further comprises a tongue 5 which projects upstream from the apex of the guide sheet 8. The tongue 5, which is located in the same plane as the guide sheet 8, extends through the gap defined by the central sections 2*a*, 3*a* of the rollers 2, 3. The length of the central sections 2*a*, 3*a* is slightly greater than the width of the tongue 5. The junction between the tongue 5 and the guide sheet 8 is situated in the region of the apex of the guide sheet 8 and the sides 5*a* of the tongue 5 merge into the sides 8*a* of the guide sheet 8 at this junction via respective radii.

A protuberance 11 is formed on the upper face of the junction between the tongue 5 and the guide sheet 8 while a protuberance 12 is formed on the lower face of the junction. The protuberances 11, 12 are part-spherical and are superimposed with one another. The protuberances 11, 12 essentially span the distance between the radii joining the tongue 5 to the guide sheet 8, that is, the widths of the protuberances 11, 12 are essentially equal to the distance between such radii. As best seen from FIG. 1, the lengths of the protuberances 11, 12 or, in other words, the dimensions of the protuberances 11, 12 in the direction of transport 6 are smaller than the widths of the protuberances 11, 12.

In operation, the drive 4 is switched on. The photographic sheets 7*a*, 7*b* are superimposed with one another in such a manner that the tongue 5 is located between the photographic sheets 7*a*, 7*b*. The photographic sheets 7*a*, 7*b* are introduced into the rollers 2, 3 while being held in this fashion. Once the photographic sheets 7*a*, 7*b* are received between the rollers 2, 3, further transport of the photographic sheets 7*a*, 7*b* is undertaken by the rollers 2, 3. As the photographic sheets 7*a*, 7*b* are advanced by the rollers 2, 3, the protuberances 11, 12 displace the photographic sheets 7*a*, 7*b* away from the critcal radii between the tongue 5 and the guide sheet 8 so that the leading edges of the photographic sheets 7*a*, 7*b* do not catch at such radii. Once the leading edges of the photographic sheets 7*a*, 7*b* have passed by the radii between the tongue 5 and the guide sheet 8, the photographic sheets 7*a*, 7*b* progressively slide along and are displaced over the sides 8*a* of the guide sheet 8. The protuberances 11, 12 also cause a wave or ridge to be formed in each of the photographic sheets 7*a*, 7*b* thereby stiffening the latter. This facilitates transport of the photographic sheets 7*a*, 7*b* beyond the guide sheet 8 and into the bath 14 via the deflectors 13.

Since the end sections 2*b*, 3*b* of the rollers 2, 3 have smaller diameters than the lateral sections 2*c*, 3*c*, the edges of large photographic sheets 7*a*, 7*b* pass through the rollers 2, 3 loosely. This reduces the chances that the photographic sheets 7*a*, 7*b* will develop creases. In this regard, the protuberances 11, 12 increase the possibility that creases will develop since the protuberances 11, 12 displace the central portions of the photographic sheets 7*a*, 7*b* from their planes thereby causing the lateral edges of the photographic sheets 7*a*, 7*b* to move slightly towards the centers of the latter. For this reason, the protuberances 11, 12 are also preferably disposed a short distance downstream of the rollers 2, 3 rather than between the rollers 2, 3. Advantageously, the protuberances 11, 12 are located so far downstream of the rollers 2, 3 that the distance b between the centerlines of the protuberances 11, 12 and a plane A defined by the axes of the rollers 2, 3 is approximately equal to the width of the free end of the tongue 5.

The conveying arrangement of the invention enables overlapping or superimposed photographic sheets *7a*, *7b* of up to and even exceeding sixty centimeters in width to be spaced reliably and without damage.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for conveying overlapping photosensitive articles, particularly photographic sheets, comprising:

(a) conveying means for conveying a pair of overlapping photosensitive articles in a predetermined direction; and (b) guide means arranged to guide the articles for movement on opposite sides of a predetermined plane, said guide means including a sheet-like first portion which is located in said predetermined plane and has an upstream end provided with a corner, and said guide means further including a tongue-like second portion which extends upstream from said upstream end, said first and second portions defining a junction region having opposite faces which flank said predetermined plane, and at least one of said faces being provided with a protuberance to thereby bias the respective article away from said predetermined plane.

2. The arrangement of claim 1, wherein the other of said faces is provided with a protuberance to thereby bias the other article away from said predetermined plane.

3. The arrangement of claim 2, wherein said protuberances are superimposed with one another.

4. The arrangement of claim 1, wherein said second portion is located in said predetermined plane.

5. The arrangement of claim 1, wherein said conveying means comprises a pair of cooperating rollers.

6. The arrangement of claim 5, wherein one of said rollers comprises a central section having a first diameter, and a pair of lateral sections which flank said central section and have second diameters larger than said first diameter.

7. The arrangement of claim 6, wherein the other of said rollers comprises a central section having a first diameter, and a pair of lateral sections which flank the respective central section and have second diameters larger than the respective first diameter.

8. The arrangement of claim 6, wherein said second portion extends between said rollers in the region of said central section.

9. The arrangement of claim 1, wherein said first portion is substantially triangular and said junction region is disposed at an apex of said first portion.

10. The arrangement of claim 9, wherein said first portion has the form of an isosceles triangle.

11. The arrangement of claim 1, wherein said first portion is provided with spacing means downstream of said protuberance for spacing the articles transversely of said predetermined plane.

12. The arrangement of claim 1, comprising a diffusion developing bath; and wherein said conveying means is arranged to convey the articles into said bath.

13. The arrangement of claim 1, wherein said protuberance is at least approximately part-spherical.

14. The arrangement of claim 1, wherein said protuberance is substantially coextensive with said second portion transversely of said predetermined direction.

15. The arrangement of claim 1, wherein said protuberance has an arcuate contour transverse to said predetermined direction.

16. The arrangement of claim 1, wherein said protuberance is arranged downstream of said conveying means.

17. The arrangement of claim 16, said conveying means including a pair of cooperating rollers having respective axes which are located in a common plane, and said protuberance having a center line which parallels said axes, said second portion having a free end which is remote from said junction region and has a predetermined width; and wherein the distance between said center line and said common plane is at least approximately equal to said predetermined width.

18. An arrangement for conveying a pair of photosensitive sheets through a bath of a diffusion developing apparatus while maintaining a space between the sheets, said arrangement comprising:

(a) a pair of cooperating rollers for drawing the sheets into the bath, each of said rollers including a central section having a first diameter, and a pair of lateral sections which flank the respective central section and have a second diameter larger than the respective first diameter, said central sections together defining a gap; and (b) a guide element arranged to guide the sheets for movement on opposite sides of a predetermined plane, said guide element including a sheet-like first portion which is located downstream of said rollers in said predetermined plane and resembles an isosceles triangle, and said first portion being arranged with an apex thereof confronting said rollers, said first portion having opposite surfaces which flank said predetermined plane, and each of said surfaces being provided with a ledge which extends along the base of said first portion, said guide element further including a tongue-like second portion which extends from said apex through said gap to a location upstream of said rollers, and said first and second portions defining a junction region having opposite faces which flank said predetermined plane, each of said faces being provided with a protuberance to thereby bias the respective sheet away from said predetermined plane.

19. An arrangement for conveying overlapping photosensitive articles, particularly photographic sheets, comprising:

(a) conveying means for conveying a pair of overlapping photosensitive articles in a predetermined direction; and (b) guide means arranged to guide the articles for movement on opposite sides of a predetermined plane, said guide means including a sheet-like first portion which is located in said predetermined plane and has an upstream end provided with a corner, and said guide means further including a tongue-like second portion which extends upstream from said upstream end, said first and second portions defining a junction region having opposite faces which flank said predetermined plane, and at least one of said faces being provided with a protuberance to thereby bias the respective article away from said predetermined plane, said first portion having opposite surfaces which flank said predetermined plane, and one of said surfaces being provided with a ledge downstream of said protuberance for spacing the articles transversely of said predetermined plane.

20. The arrangement of claim 19, wherein a ledge is provided on the other of said surfaces.

21. The arrangement of claim 20, wherein said ledges are superimposed with one another.

22. The arrangement of claim 19, wherein said first portion has a side which is transverse to said predetermined direction and said ledge is adjacent to said side.

23. The arrangement of claim 19, wherein said ledge extends transverse to said predetermined direction.

24. The arrangement of claim 23, wherein said ledge is substantially coextensive with said first portion transversely of said predetermined direction.

25. An arrangement for conveying overlapping photosensitive articles, particularly photographic sheets, comprising:

(a) conveying means for conveying a pair of overlapping photosensitive articles in a predetermined direction, said conveying means including a pair of cooperating rollers, and one of said rollers comprising a pair of end sections having a first diameter, and another section which is flanked by said end sections and has a second diameter larger than said first diameter; and (b) guide means arranged to guide the articles for movement on opposite sides of a predetermined plane, said guide means including a sheet-like first portion which is located in said predetermined plane and has an upstream end provided with a corner, and said guide means further including a tongue-like second portion which extends upstream from said upstream end, said first and second portions defining a junction region having opposite faces which flank said predetermined plane, and at least one of said faces being provided with a protuberance to thereby bias the respective article away from said predetermined plane.

26. The arrangement of claim 25, wherein the other of said rollers comprises a pair of end sections having a first diameter, and another section which is flanked by the respective end sections and has a second diameter larger than the first diameter of the respective end sections.

27. The arrangement of claim 25, wherein said one roller comprises an additional section which is flanked by said end sections and has said second diameter, said one roller further comprising a central section which is flanked by said other and said additional sections and has a diameter smaller than said second diameter.

28. The arrangement of claim 25, wherein the length of each of said end sections is about one-fourth to one-third the length of said one roller.

* * * * *